United States Patent [19]

Pilachowski

[11] Patent Number: 4,643,611

[45] Date of Patent: Feb. 17, 1987

[54] VIBRATORY COMPACTOR HAVING IMPROVED CAST BASE

[75] Inventor: Martin Pilachowski, Kewaskum, Wis.

[73] Assignee: Wacker Corporation, Milwaukee, Wis.

[21] Appl. No.: 721,077

[22] Filed: Apr. 8, 1985

[51] Int. Cl.[4] ..... E01C 19/34; E01C 19/38; E01C 19/40

[52] U.S. Cl. ..... 404/133; 74/61

[58] Field of Search ..... 404/133, 102, 113, 114; 74/61, 87; 366/108

[56] References Cited

U.S. PATENT DOCUMENTS

| | | | |
|---|---|---|---|
| 3,782,845 | 1/1974 | Briggs et al. | 404/133 |
| 3,817,646 | 6/1974 | Opderbeck | 404/133 |
| 3,832,080 | 8/1974 | Stoecker | 404/133 |
| 4,067,244 | 1/1978 | Baumers | 74/61 |
| 4,113,403 | 9/1978 | Tertinek et al. | 404/113 |

*Primary Examiner*—James A. Leppink
*Assistant Examiner*—Matthew Smith
*Attorney, Agent, or Firm*—James E. Nilles

[57] ABSTRACT

The base plate and the exciter housing in the vibratory compactor of this invention comprise a one-piece casting of ductile nodular iron. The exciter housing portion of that casting, located at the front of the base plate, has coaxial holes in its opposite side walls, each large enough to receive the exciter axially. In each such hole is axially slidably received a substantially cylindrical bearing support into which a bearing for the exciter shaft is coaxially press fitted. Tab portions on each bearing support, projecting radially beyond its cylindrical surface, overlie the exterior surface of its housing side wall and provide for securement of the bearing support to that side wall by means of bolts.

4 Claims, 7 Drawing Figures

VIBRATORY COMPACTOR HAVING IMPROVED CAST BASE

FIELD OF THE INVENTION

This invention relates to vibratory compactors for soil, gravel and the like, of the type comprising a base plate that has a substantially flat bottom, a prime mover carried by the base plate, an exciter comprising an eccentric mass that is rotatably driven by the prime mover to impart up and down vibration to the base plate, and a handle projecting up from the base plate for guiding and propelling the compactor; and the invention is more particularly concerned with improvements in such a compactor whereby its cost is decreased, its manufacture is simplified, its useful life is prolonged, and repair and maintenance of it are facilitated.

BACKGROUND OF THE INVENTION

In a vibratory compactor of the type to which this invention relates the exciter is enclosed in a housing near the front of the base plate, while the prime mover—usually an internal combustion engine—is carried on the base plate behind the exciter housing and is connected with the exciter as by means of a belt transmission. By reason of its location near the front of the base plate, the exciter has a tendency to propel the machine forward, so that the forces which the operator has to exert upon the handle are mainly for guidance. The housing in which the exciter is enclosed serves as a guard for its rapidly rotating eccentric mass and also comprises a reservoir for a supply of oil by which the exciter bearings are lubricated and cooled. The oil is splashed onto the bearings by the vibration that the exciter generates and the turbulence that its rotation induces in the housing.

Heretofore vibratory compactors have usually been made with either steel base plates or cast base plates. In a compactor with a steel base plate, structure above the base plate that is rigidly secured to it can be welded to it to provide a sturdy, permanent connection. With a cast base plate such structure must be fastened to the base plate by means of bolts or the like, for which aligned holes have to be provided in the connected parts.

A base plate cast from ductile or so-called nodular iron is superior to a steel base plate with respect to wear and abrasion resistance. Heretofore, however, the exciter housing for a compactor having a cast base plate was made as a separate casting that was bolted to the base plate casting. In one version the exciter housing casting was formed as a body having a cavity in its interior that opened outward only through bearing holes in its opposite side walls. Such an exciter housing held only a small quantity of oil. In another version, which held substantially more oil, the base plate casting defined the bottom portion of the exciter housing, and the exciter housing casting and the base plate casting had mating edge surfaces that had to be machined for a close fit to prevent oil leakage out of the housing. In either case the two castings had to be provided with pads for the bolts that fastened them together, and these pads had to be accurately drilled and tapped. Because of the costs of machining, drilling and tapping, and of the fasteners and operations needed for assembly, the cost of a compactor having a cast base plate tended to be higher than that of an equivalent compactor having a steel base plate. In addition, the pads and flanges on the two casting parts, needed for connecting and sealing them, added a substantial amount of weight to the casting structure. As is well known to those familiar with compacting equipment, heavy weight is not in itself a desirable attribute of a vibratory compactor. Compacting effectiveness depends mainly upon the vibratory force that the machine imposes upon the material to be compacted, and in any event detachable weights can be installed on the machine if more weight is desired.

Compactors of the types described above have been manufactured for many years. During all of that time it had been obvious to those concerned with such machines that reduction of the cost and weight of compactors having cast base plates could give them a significant competitive advantage relative to those with steel base plates. Evidently, it was not obvious how this advantage could be attained.

One supposed obstacle to the improvement of compactors with cast base plates related to the assembly of the exciter into its housing. Before the exciter housing casting was fastened to the base plate, the exciter shaft and its eccentric mass were inserted into the housing casting through coaxial bearing bores in its side walls and the bearings for the exciter shaft were press fitted into those bores. It seemed obvious that forming the exciter housing in one piece with the base plate would have complicated factory assembly and would have made field replacement of the press fitted bearings difficult or impossible, owing to the need for manipulating the whole large, heavy and awkwardly shaped base plate casting and correctly positioning and supporting it in an arbor press for installation of the exciter shaft bearings.

SUMMARY OF THE INVENTION

The general object of the present invention is to provide a vibratory compactor having a cast base plate that can be produced with fewer and less expensive machining operations and can be assembled more quickly and easily than prior such compactors, but which can nevertheless be disassembled and reassembled in the field for replacement of its exciter bearings without unusual difficulty or the need for special equipment.

Another general object of the invention is to provide a vibratory compactor which has a cast base plate and which is thus capable of a longer useful life than one with a steel base plate, but which is substantially lighter and less expensive but nevertheless more sturdy than prior equivalent compactors with cast base plates.

A more specific object of the invention is to provide a vibratory compactor having a cast base plate and having an exciter housing in which the exciter rotates and which contains a supply of oil for lubricating the exciter bearings, said exciter housing being cast in one piece with the base plate so that there is no chance for leakage of oil out of a joint between that housing and the base plate, but the compactor nevertheless being so arranged that the exciter can be very easily installed into and removed from the exciter housing.

An additional specific object of the invention is to provide a vibratory compactor having a part formed as a casting that comprises an exciter housing as well as a base plate, said casting having substantially fewer pads and other complicating features than were heretofore considered necessary on a compactor base plate casting, so as to be lighter and capable of being produced at substantially lower costs for molds and machining, but nevertheless being stronger and more reliable than the counterpart elements in prior compactors.

A further specific object of the invention is to provide a vibratory compactor of the character described that affords longer life for the exciter bearings by reason of its having an exciter housing that is compact but nevertheless capable of holding a large quantity of oil by which the bearings are lubricated and by which heat is transferred from them to the base plate.

It is also an object of this invention to provide a vibratory compactor having a cast base plate structure that requires fewer and less difficult machining operations than prior such machines.

These and other objects of the invention that will appear as the description proceeds are achieved in the vibratory compactor of this invention, which is of the type that comprises a base plate having a substantially flat bottom surface, power drive means supported on one portion of the base plate, an exciter in an exciter housing on another portion of the base plate, and a handle projecting up from the base plate for guiding and propelling the compactor. The exciter comprises a shaft which is rotatable in a pair of bearings and to which an eccentric mass is anchored, for imparting up and down vibration to the base plate. Said shaft is drivingly connected with the power drive means by a transmission means which may comprise a belt.

The vibratory compactor of this invention is characterized in that its base plate and its exciter housing comprise a one-piece casting. The portion of said casting that provides the exciter housing has a cavity in its interior and has a pair of opposite upright side walls through each of which there is a bore that opens from said cavity. Those bores are coaxial and each of them is of large enough diameter for the exciter to pass through it axially. For each of said side walls there is a bearing holder, and each bearing holder has a bearing bore into which one of said bearings is press fitted and has a radially outer cylindrical surface concentric to its bearing bore that is closely but axially slidably received in the bore in its side wall. Each bearing holder has pad-like marginal portions which project radially outwardly beyond its said cylindrical surface at locations spaced circumferentially around that surface and which overlie the exterior of its exciter housing side wall and cooperate with fastening means to detachably secure the bearing holder against displacement relative to its side wall.

BRIEF DESCRIPTION OF THE DRAWINGS

In the accompanying drawings, which illustrate what is now regarded as a preferred embodiment of the invention.

DETAILED DESCRIPTION OF THE PREFERRED EMBODIMENT OF THE INVENTION

Figure 1:
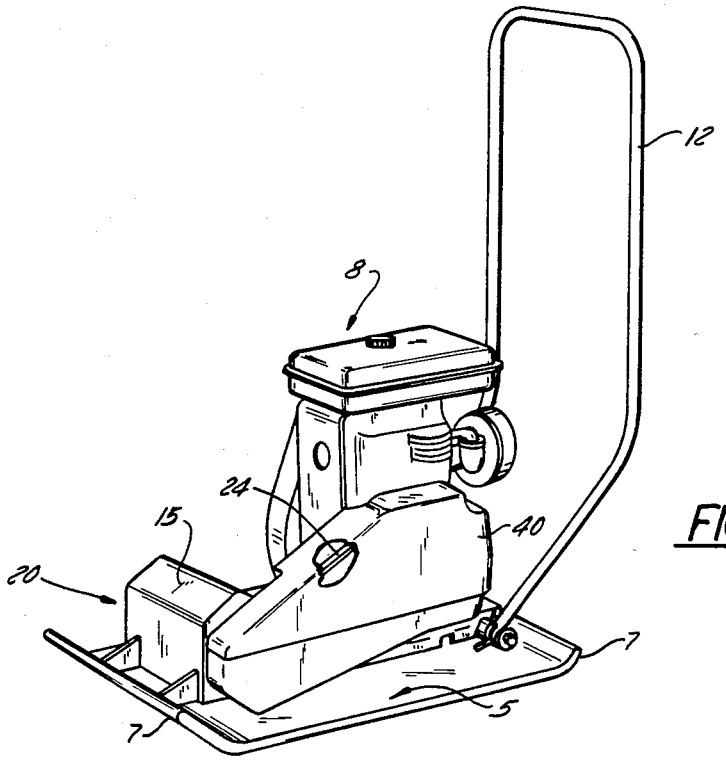
FIG. 1 is a perspective view of a vibratory compactor that embodies the principles of this invention.
Figure 2:
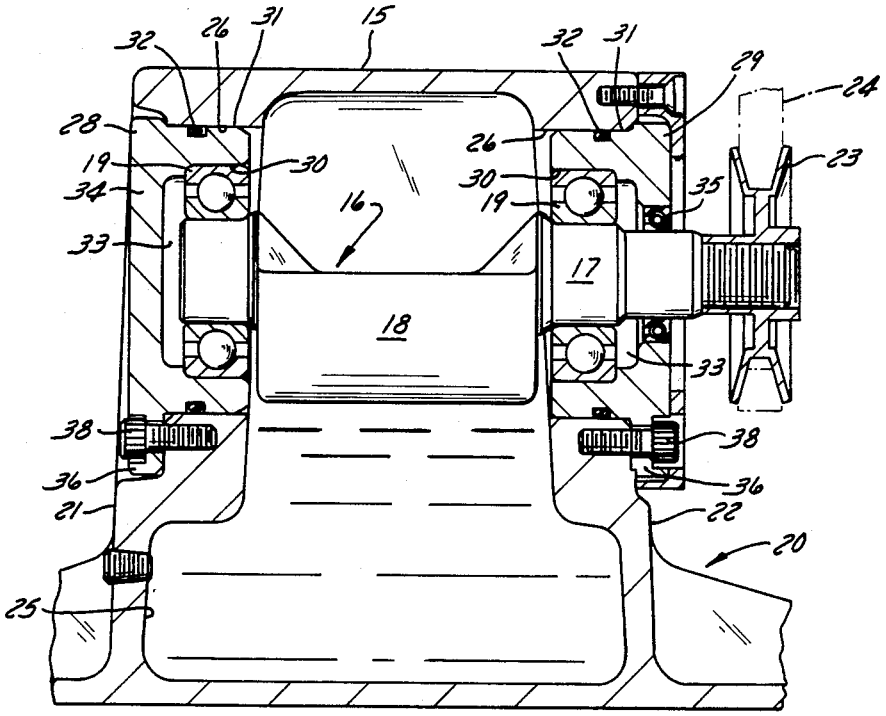
FIG. 2 is a view in section on a vertical plane that contains the axis of the exciter shaft and extends through the casting that comprises the base plate and the exciter housing.
Figure 3:
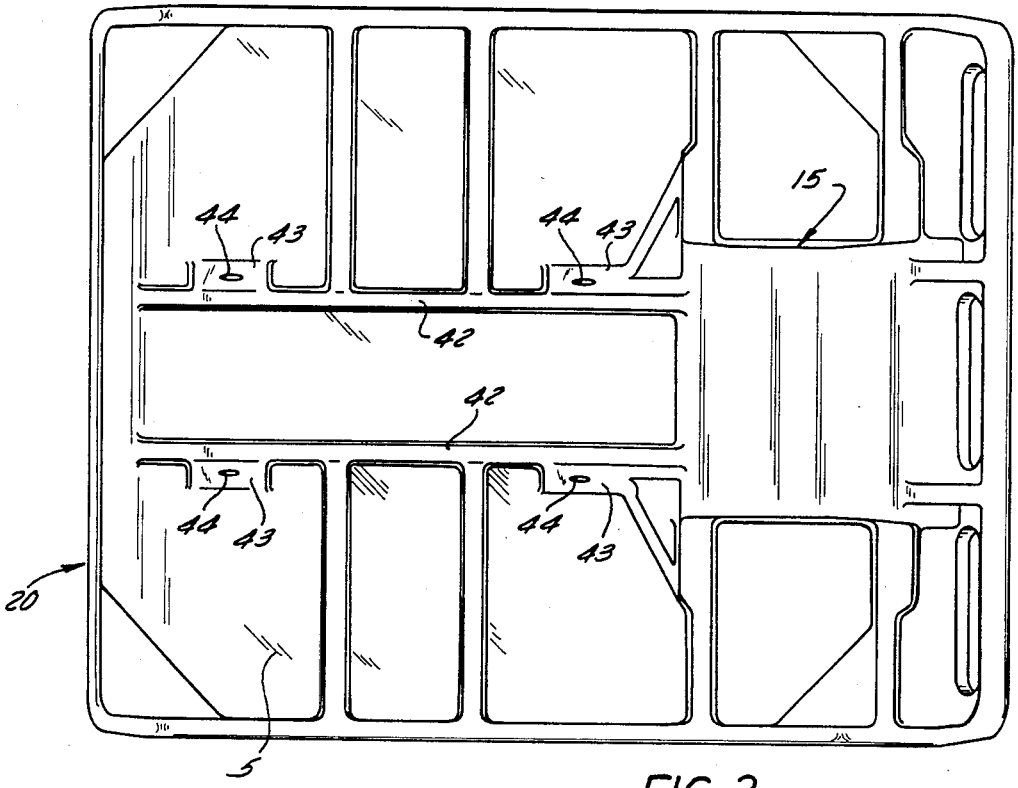
FIG. 3 is a plan view of the casting comprising the base plate and the exciter housing.
Figure 5:
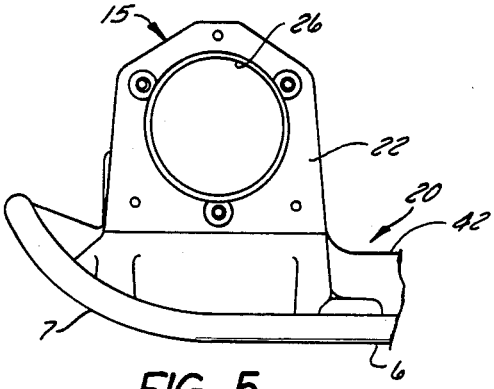
FIG. 5 is a fragmentary view generally similar to FIG. 4, but from the left side of the casting.
Figure 4:
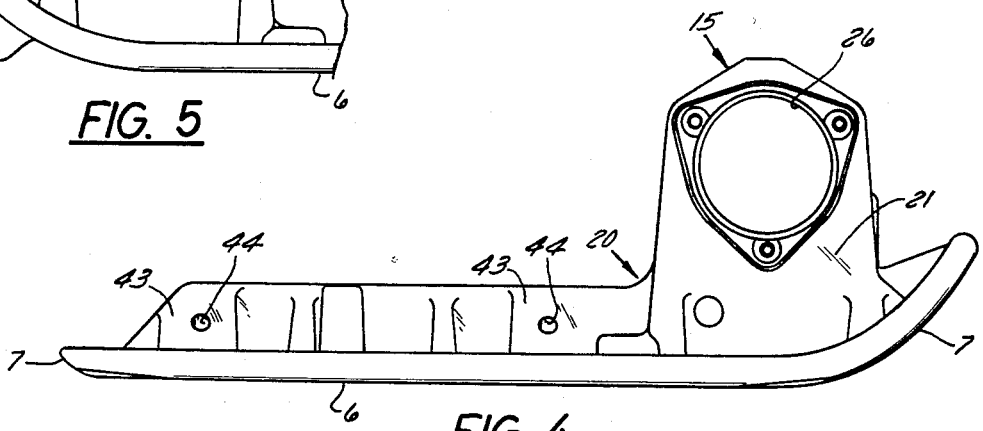
FIG. 4 is a view in side elevation of the casting shown in FIG. 3, as seen from the right side thereof.
Figure 6:
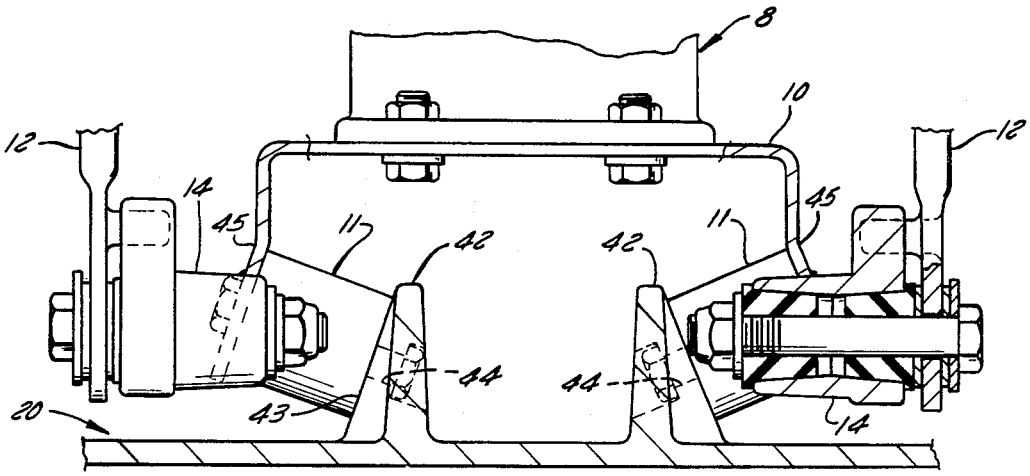
FIG. 6 is a fragmentary view in vertical section taken substantially on a plane containing the axis of the connection between the handle and the console plate.
Figure 7:
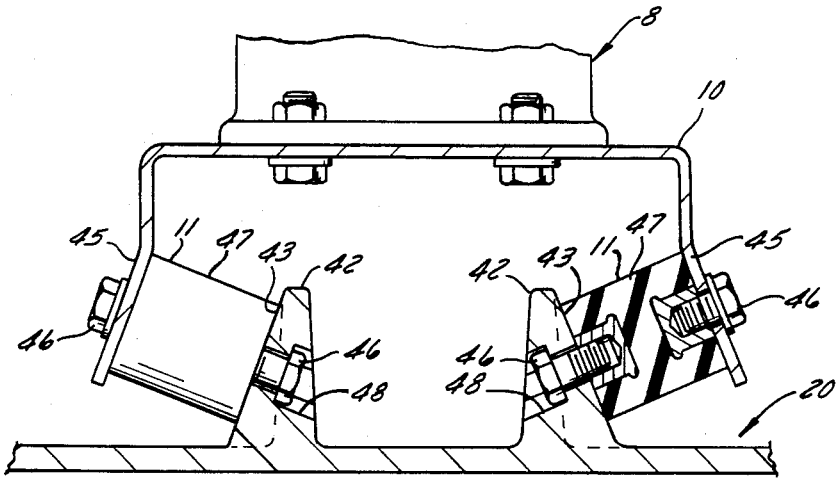
FIG. 7 is a view generally like FIG. 6 but taken substantially in a vertical plane at a connection between the base casting and the console plate.

A vibratory compactor that embodies the principles of this invention is conventional in having a base plate 5 which is substantially rectangular as viewed from above. The bottom surface 6 of the base plate is flat over most of its area, for engaging the surface of soil or the like to be compacted, but its marginal portions curve upwardly, as at 7, to facilitate passage of the machine across irregularities in the surface to be compacted.

Supported on a rear portion of the base plate is a power drive means or prime mover 8, here shown as a single-cylinder internal combustion engine. Instead of being directly secured to the base plate 5, the prime mover 8 is attached to a so-called console plate 10 which, in turn, has shock-absorbing connections 11 to the base plate that tend to isolate the prime mover from the intense vibration to which the base plate is subjected. An upwardly and rearwardly projecting handle 12 for guiding and propelling the machine is preferably connected to the console plate 10 by coaxial shock mounts 14, to be doubly insulated from the vibrations of the base plate.

On the front portion of the base plate is an exciter housing 15 in which an eccentric exciter 16 is rotatable and which holds a substantial quantity of oil. The exciter 16 comprises a rotatable shaft 17 which has its axis extending laterally in relation to the base plate and to which an eccentric mass 18 is anchored. Preferably the eccentric mass 18 is formed in one piece with the shaft 17. Bearings 19 for the shaft 17 are secured in opposite upright side walls 21, 22 of the exciter housing so that the acceleration forces due to rotation of the eccentric mass 18 are transferred substantially directly to the base plate 5, producing vigorous up and down vibration of it and also imposing a forward propulsive force upon it. Under the influence of this vibration and of turbulence due to rotation of the exciter, the oil in the exciter housing is splashed around the interior of that housing and into the bearings 19 to lubricate and cool them.

One end of the exciter shaft 17 projects beyond its adjacent side wall 22 of the exciter housing and has a sheave 23 secured to it to provide for a belt transmission driving connection 24 between the exciter 16 and the prime mover 8. A belt guard 40 that encloses the belt 24 and the sheaves around which it is trained is secured to the console 10 and is cantilevered from it with one side of its front end portion closely adjacent to the exciter housing 15.

In the compactor of this invention the exciter housing 15 and the base plate 5 constitute a one-piece casting 20. The exciter housing portion 15 of this casting is hollow, and the cavity 25 in its interior opens outwardly through a relatively large hole 26 in each of the housing portion side walls 21, 22. It will be understood that the cavity 25 in the one-piece casting is defined by a sand core that is broken up after the casting has cooled and is removed through the holes 26 in its side walls.

The two holes 26 are machined to provide them with accurately cylindrical and concentric surfaces. They are preferably of like diameter, each being large enough for the exciter 16 to pass through it axially, and they are preferably so located that the lower edge of each is some distance above the bottom of the cavity 25, to be above the level of a substantial quantity of oil in the housing.

The two bearings 19 for the exciter shaft 17 are press-fitted into respective bearing supports 28, 29, which are, in turn, mounted in the respective exciter housing side walls 21, 22. Each of the bearing supports 28, 29 comprises a substantially annular body having a bore 30 wherein a bearing 19 is received and an outer cylindrical surface 31 which is concentric with its bearing bore 30 and is closely but slidably received in the bore 26 in its side wall 21, 22 of the exciter housing.

Each bearing support 28, 29 has a circumferential groove in its cylindrical surface 31, between the opposite ends of that surface, in which is received an O-ring 32 that is confined under radial compression between the bearing support and its exciter housing side wall 21, 22, to provide an oil seal around the bearing support.

In the bearing support 28 that is remote from the sheave 23, the bearing bore 30 is a blind bore, terminating at a concentric smaller diameter shallow well 33 which is defined by an integral end wall portion 34 of that bearing support. Oil passing through the bearing 19 in that bearing support 28 is trapped in the well 33 by its end wall portion 34.

The exciter shaft 17 must extend through and beyond the other bearing support 29, which is adjacent to the sheave 23, and the bearing bore 30 in that bearing support opens outwardly to a concentric smaller diameter bore portion in which there is compressed a resilient oil seal 35 that surrounds the exciter shaft 17.

Each of the bearing supports 28, 29 has a plurality of tablike marginal portions or flanges 36 which project radially outwardly beyond its cylindrical surface 31 at locations spaced circumferentially around that surface. These tab-like portions have coplanar inner surfaces to flatwise overlie the exterior surface of the side wall 21, 22 in which the bearing support 28, 29 is received. A hole through each tab-like portion aligns with a threaded blind bore in its underlying side wall 21, 22 to receive a bolt 38 by which the bearing support is readily detachably secured to the side wall.

It will be apparent that the bearing supports 28, 29 are of such size and shape that the bearings 19 can be readily inserted into them by means of a small conventional arbor press and readily removed from them with a conventional puller. It will also be apparent that with the bearings press fitted into the two bearing supports, the exciter 16 can be inserted loosely into the housing portion of the casting through one of the bores 26 therein, and then the assemblies comprising the bearing supports are merely slipped onto the end portions of the exciter shaft 17 and into the bores 23, after which installation of the bolts 38 confines the exciter in the housing.

With a heretofore conventional cast base plate, the bottom portion of the exciter housing was integral with the base plate casting, defining a relatively shallow, more or less rectangular ridge on its top surface. At the front and rear sides of this ridge, near its corners, it was widened to form pads that were drilled and tapped for bolts by which the exciter housing casting was secured to the base casting. From the two pads at the rear of this ridge a pair of integral stiffening ribs extended rearward along the top of the base plate. The height of these ribs could not usefully be any greater than that of the pads from which they extended.

With the present invention, wherein the exciter housing is cast in one piece with the base plate, there are two longitudinal stiffening ribs 42 on the casting 20, paralleling the longitudinal centerline of the base plate and spaced symmetrically to opposite sides of it. At their front ends these ribs 42 join the rear wall of the exciter housing 15. The ribs 42 can be deeper but narrower than their counterparts on prior cast base plates so that they provide greater strength with no increase in weight.

Elimination of the mounting pads at the front of the exciter housing allows the base plate to be made correspondingly shorter, thus decreasing its weight without sacrifice of strength or compacting effectiveness.

On the top surface of a prior conventional base plate casting, spaced behind the ridge for the exciter housing, there were pads that were drilled and tapped downwardly to receive bolts for the shock mounted connections between the console and the base plate casting. On the one-piece casting 20 of this invention the greater depth of the longitudinal ribs 42 makes possible the elimination of the pads for console mounting and the machining operations that were needed on them. Instead, each of the longitudinal ribs 42 is thickened to provide a pad 43 at each of two locations that are spaced along its length, the pads 43 on each rib 42 being on its side surface remote from the other rib. At each of these locations a hole 44 is cored through the rib and its pad 43 to receive a bolt for one of the shock mount connections 11 between the console 10 and the base plate. Each of the holes 44 has its axis at a small angle to the horizontal, inclined upwardly and laterally away from the longitudinal centerline of the base plate.

The console plate 10 has downwardly projecting flanges 45 along its opposite sides which overlie the pads 43 in outwardly spaced relation to them and in which there are holes that align with the holes 44 in the casting and provide for connection of the console to the shock mounts 11. Each of the shock mounts comprises a pair of coaxial bolts 46 threaded into opposite sides of a cushion-like vibration damper 47.

To facilitate assembly, each of the bolt receiving holes 44 in the ribs 42 terminates at its inner end at a coaxial hexagonal recess 48 in which the hexagonal head of a shock mount bolt 46 is received with a close fit that holds it against turning.

From the foregoing description taken with the accompanying drawings it will be apparent that this invention provides a vibratory compactor having a base plate of nodular iron that is cast in one piece with an exciter housing and wherein the exciter is very easily assembled and removed for convenient installation and replacement of its bearings. It will also be apparent that the one-piece base plate and exciter housing of this invention can be substantially lighter than a heretofore conventional base plate and exciter housing assembly of comparable size and requires fewer and less difficult machining operations.

What is claimed as the invention is:

1. A vibratory compactor of the type comprising a base plate having front and rear ends, laterally opposite sides, a top and a substantially flat bottom surface, power drive means supported on a plate-like console which is, in turn, supported on a rear portion of the base plate by means of a plurality of shock mounts, each comprising a pair of coaxial bolts threaded into opposite sides of a vibration damper, an exciter in an exciter housing on a front portion of the base plate, said exciter comprising a shaft which is rotatable in a pair of bearings and to which an eccentric mass is anchored for imparting up and down vibration to the base plate, transmission means drivingly connecting the power drive means with said shaft, and a handle projecting up from the base plate for guiding and propelling the compactor, said compactor being characterized by:

A. the base plate, the exciter housing and a pair of elongated ribs on the top of the base plate comprising a one-piece casting of ductile nodular iron, the portion of said casting that comprises the exciter housing
   (1) having a cavity in its interior and
   (2) having a pair of opposite upright side walls that are spaced laterally inwardly from said opposite sides of the base plate and through each of which there is a bore that opens from said cavity, said bores being coaxial and having bottom edge portions spaced above the bottom of said cavity and at least one of said bores being of large enough diameter for the exciter to pass axially therethrough;

B. a pair of bearing holders, one for each of said side walls, each said bearing holder having
   (1) a bearing bore in which one of said bearings is received with a press fit,
   (2) a radially outer cylindrical surface concentric to its bearing bore and which is closely but axially slidably received in the bore in its side wall, and
   (3) marginal portions which project radially outwardly beyond said cylindical surface at locations spaced circumferentially around the same and which overlie the exterior of its side wall and cooperate with fastening means to detachably secure the bearing holder against displacement relative to its side wall;

C. each of said ribs projecting upwardly from the top of the base plate and extending lengthwise fore-and-aft along it, said ribs being laterally spaced from one another and from said laterally opposite sides of the base plate,
   (1) each said rib being integrally joined at a front end thereof to a rear wall of said portion of the casting that comprises the exciter housing, and
   (2) each said rib having a pair of holes transversely therethrough that are spaced from one another along its length and in each of which one of said bolts of a shock mount is receivable; and D. said console having downwardly projecting flange portions at opposite sides thereof that laterally outwardly overlie the respective ribs, said flange portions having holes which align with said holes in their respectively adjacent flanges and in each of which the other of said bolts of a shock mount is receivable.

2. The vibratory compactor of claim 1 wherein said bores in said side walls are of like diameter.

3. The vibratory compactor of claim 1 wherein each of said holes in said ribs, at its end adjacent to the other rib, opens to a coaxial noncircular recess in which the head of one of said bolts is closely receivable and is confined against rotation.

4. The vibratory compactor of claim 1 wherein each of said ribs is locally thickened in the neighborhood of each of said holes therein to provide a pad at its side remote from the other rib.

* * * * *